United States Patent [19]

Häuser et al.

[11] Patent Number: 4,787,225

[45] Date of Patent: Nov. 29, 1988

[54] KEY FOR A LOCK CYLINDER

[75] Inventors: Herbert P. Häuser, Elsdorf-Heppendorf; Alexander Stefanescu, Cologne, both of Fed. Rep. of Germany

[73] Assignee: DOM-Sicherheitstechnik GmbH & Co KG, Bruhl, Fed. Rep. of Germany

[21] Appl. No.: 932,468

[22] Filed: Nov. 18, 1986

[30] Foreign Application Priority Data

Nov. 27, 1985 [DE] Fed. Rep. of Germany ..... 3541928
Apr. 26, 1986 [DE] Fed. Rep. of Germany ..... 3614222

[51] Int. Cl.[4] ..... E05B 19/02

[52] U.S. Cl. ..... 70/401; 70/402; 70/407; 70/393; 70/395

[58] Field of Search ..... 70/393, 395, 401, 402, 70/407

[56] References Cited

U.S. PATENT DOCUMENTS

| | | | |
|---|---|---|---|
| 1,564,883 | 12/1925 | Muzzio | 70/401 X |
| 1,832,498 | 11/1931 | Muzzio | 70/401 |
| 2,006,374 | 7/1935 | Voges | 70/393 X |
| 2,620,649 | 12/1952 | Bernardo | 70/401 X |
| 3,492,842 | 2/1970 | Schlage | 70/401 X |
| 4,429,554 | 2/1984 | Litvin et al. | 70/395 X |
| 4,498,327 | 2/1985 | Preddey et al. | 70/401 X |
| 4,603,565 | 8/1986 | Strassmeire | 70/401 X |

FOREIGN PATENT DOCUMENTS

| | | | |
|---|---|---|---|
| 1186776 | 2/1965 | Fed. Rep. of Germany | 70/401 |
| 2565281 | 12/1955 | France | 70/395 |
| 413271 | 4/1946 | Italy | 70/401 |
| 517655 | 2/1940 | United Kingdom | 70/401 |

*Primary Examiner*—Robert L. Wolfe
*Assistant Examiner*—Suzanne L. Dino
*Attorney, Agent, or Firm*—Barry E. Deutsch

[57] ABSTRACT

For increased security the key (2; 40; 44) has one or more blade portions (43; 45; 46; 5, 6). The longitudinal central plane (A, B) of the or each blade portion is offset from the guide region (42; 7) running along the back edge of the key shaft (3). Furthermore, the or each blade portion is connected to the guide region by means of a bridging portion (14, 14') which forms an obtuse angle (alpha) with the guide region, as well as forming an obtuse angle with the blade portion. In one preferred embodiment two blade portions (45, 46; 5, 6) are provided; they may be of the same cross-sectional shape (FIG. 2) or symmetrical (FIG. 11). The blade portions and guide region may be divided into two portions to provide partner keys (FIG. 12).

22 Claims, 5 Drawing Sheets

FIG. 3
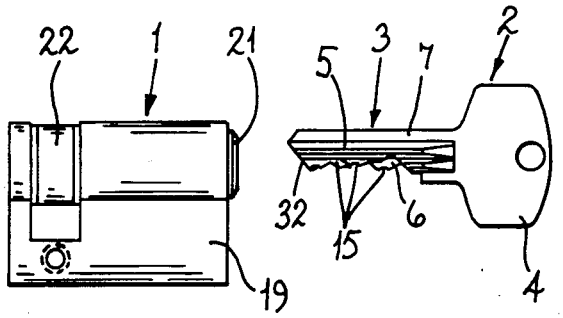
FIG. 4
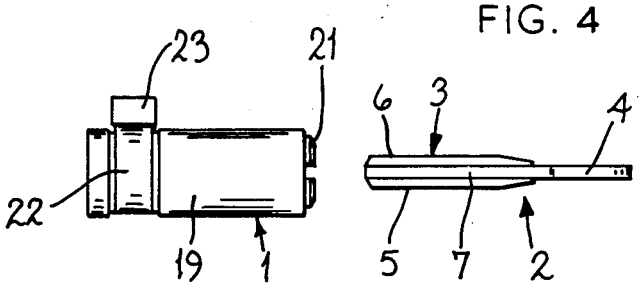
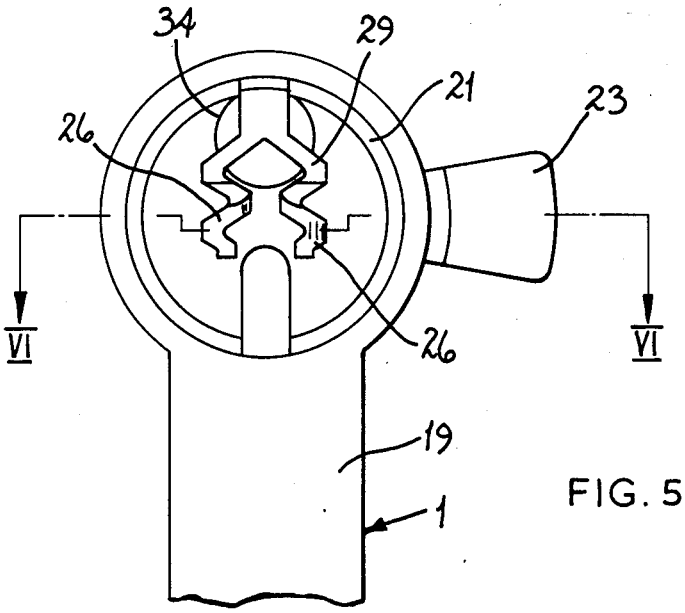
FIG. 5

FIG. 8
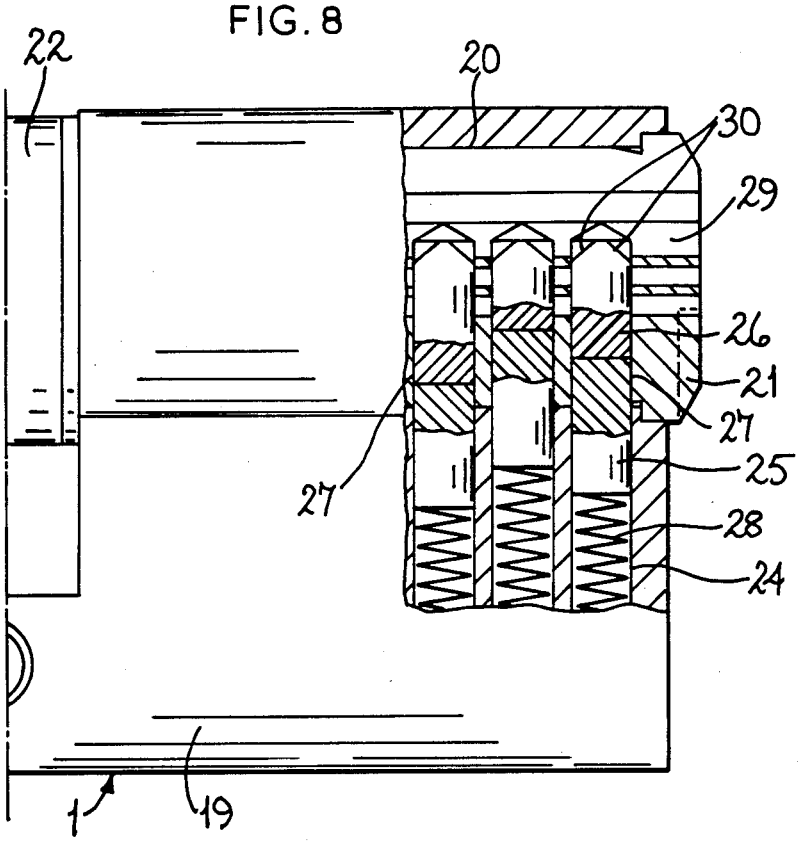
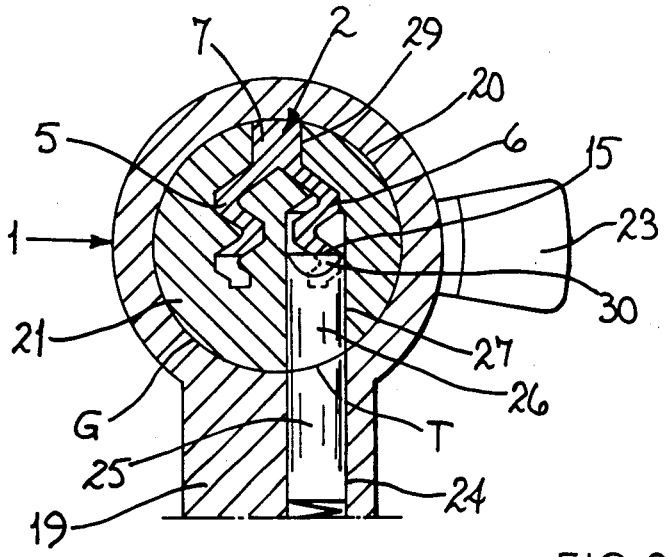
FIG. 9

FIG. 10
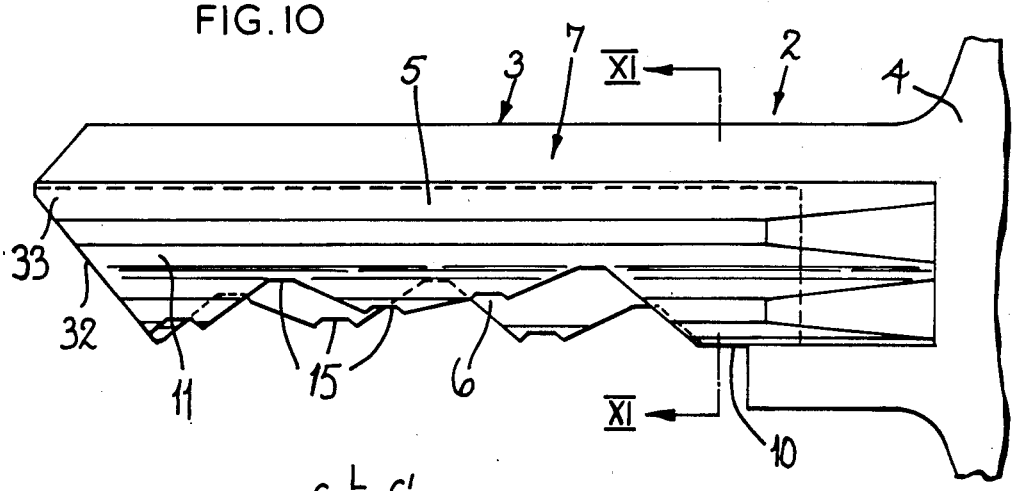
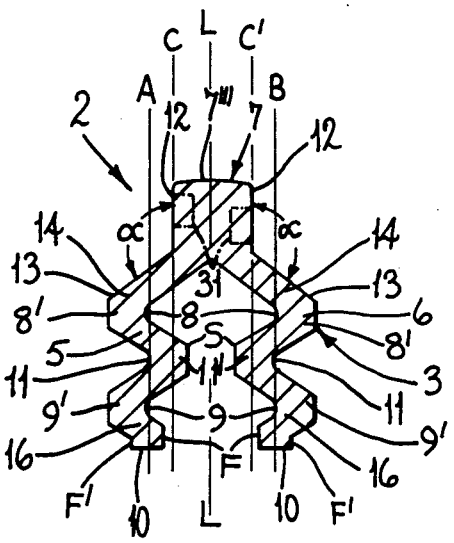
FIG. 11
FIG. 12
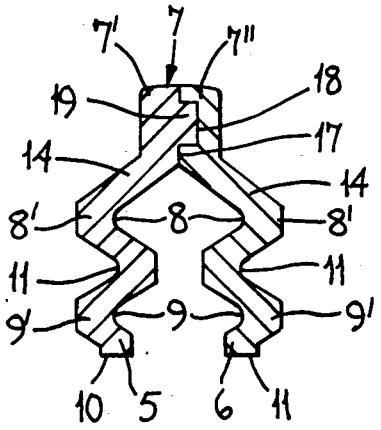

KEY FOR A LOCK CYLINDER

This invention is concerned with a key for a cylinder lock comprising a guide region extending along a back edge portion of the key for guiding the key along a keyway of the cylinder, and at least one blade portion having a narrow edge opposite the guide region, in which edge V-cuts are formed for operating tumbler pins of the cylinder, said blade portion also having formed in one side surface thereof at least one longitudinal rib portion flanked at each side by a longitudinal groove.

Such a key is known from DE-PS No. 2551523, wherein the blade portion is aligned with the guide region. This leads to the possibility of accessing the region of the cylinder accommodating the tumbler pins by means of a picking tool inserted into the keyway which is formed with a relatively large cross-section, in order to operate the tumblers.

Furthermore a key is disclosed by DE-OS No. 3021128, wherein, as seen in cross-section, an arcuately curved blade portion extends from the guide region. Also in this case the blade portion cannot be regarded as offset from the guide region so that the possibility arises of accessing the lock cylinder tumblers by means of a picking tool having a flat form appropriately curved, in order to be able then to operate said tumblers.

The present invention has its object to provide a relatively simple construction of key wherein, despite the relatively large dimensions of the guide region of the key, and consequently of the keyway, the overall key shape is such that a high protection against picking is ensured.

This object is resolved, in accordance with the present invention, in a key as set out in the first paragraph above, in that each blade portion is connected to the guide region by a bridging portion and the longitudinal central plane of each blade portion is offset from that of the guide region such that the side surface of the guide region facing said plane forms an obtuse angle with the bridging portion, and in that an extension of the plane of the side surface of the guide region passes through the peak region of the rib portion(s) formed in the side surface of the blade portion.

As a result of such construction a key of the type in question is provided with enhanced security value, and indeed without dispensing with a guide region having a relatively large cross-sectional dimension. This brings advantages in inserting and withdrawing the key. More particularly, although the guide region, which is of relatively large cross-sectional dimension, allows the insertion of a picking tool into the corresponding region of the keyway, it is very difficult for this to reach the offset region of the keyway corresponding to the blade portion of the key via the obliquely lying intermediate channel which receives the bridging portion. The operation of the lock cylinder tumbler pins is thus effectively prevented. Although the guide region and the longitudinal central plane of the blade portion are offset the keyway region engaged by the blade portion can be shielded, the degree of such shielding depending upon the distance between the projection of the plane of the side surface of the guide region and the peak region of the rib portion. The keyway region engaged by such peak region is likewise accessible only with difficulty by a picking tool.

Conveniently the grooves flanking each rib portion through the peak region of which the extension of the plane of the guide region side surface passes extend beyond the longitudinal central plane of the blade portion. By thus forming each blade portion, a large-dimension annular portion is provided, which requires a correspondingly shaped portion in the keyway, rendering picking again additionally difficult.

Such security can indeed be further enhanced, if desired, by the extension of the plane of the opposite side surface of the guide region being spaced from said peak region of each rib portion by a distance which is greater than the distance by which such peak region extends beyond the extension of the plane of said one side surface of the guide region.

An enhanced lock security is achieved by the key comprising two blade portions extending parallel with one another and each being connected to the guide region by a bridging portion as aforesaid. Such an arrangement facilitates an enhanced variation in profile. More particularly more grooves and ribs can be provided on the two blade portions. It is also possible to arrange the height of the blade portions greater than the height of the guide region, so that a greater groove depth for the V-cuts can be achieved. The corresponding lock cylinder then has two rows of tumblers lying parallel with one another. Furthermore, by providing the two grooves adjacent to the rib portion on the inner surface of each of the blade portions, it is also difficult to prepare a copy key. An impression from the inside cannot practically be in any way produced.

Whereas the two blade portions may be formed integral with a single guide region, alternatively the two blade portions may each have an associated guide region portion with which it is connected by a bridging portion as aforesaid, and the two guide region portions may then be interconnected to form a single guide region having a closed form which can be received in the keyway of the cylinder. In such a case, furthermore, it is possible to extend each guide region portion into a handle so that partner keys can also be produced, e.g. for insertion in bank safes etc. In this case it is a question of two fully effective individual keys.

Advantageously where two blade portions are provided, they are of the same shape. Thus, opposite the grooves of the one blade portion lie peak regions of the other blade portion. Also with this solution the production of a copy is rendered difficult. Alternatively, the two blade portions may be symmetrical in shape, the plane of symmetry coinciding with the longitudinal central plane of the guide region. Also with this solution the lock variation is comparatively greater than the sum of lock variations of two individual lock cylinders, since the two parts still are related.

For ease of insertion of the key into the keyway, furthermore, preferably the guide region and each, blade portion run together at the tip of the key.

There now follows a detailed description, to be read with reference to the accompanying drawings, of three keys in accordance with the invention. It will be appreciated that these three keys have been selected for description merely by way of non-limiting example of the invention.

In the accompanying drawings

FIG. 3 is a view of a third key in accordance with the invention, together with its associated lock cylinder;

FIG. 4 is a plan view of the key and cylinder shown in FIG. 3;

FIG. 5 is a front view, on a very enlarged scale, of the lock cylinder of FIGS. 3 and 4;

FIG. 8 is a section along the line VIII—VIII of FIG. 7;

FIG. 9 is a cross-section corresponding to FIG. 7, but with the key inserted;

FIG. 10 is a view, on very enlarged scale, of the third key in accordance with the invention;

FIG. 11 is a section along the line XI—XI of FIG. 10; and

FIG. 12 a section representation corresponding to FIG. 11, but wherein the key is made up of two parts.

Figure 1:
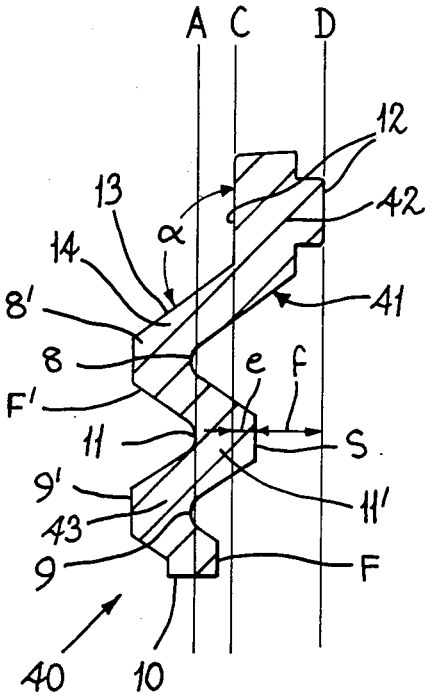
FIG. 1 is a cross-section, on a very enlarged scale through a first key in accordance with the invention.

In FIG. 1 is shown a first key 40 in accordance with the invention, said key having a shaft 41 made up of a guide region 42 running along the back edge of the key and a blade portion 43. The guide region 42 is thus arranged offset to the longitudinal central plane A of the blade portion 43. The side surface 12 of the guide region 42, which surface faces the plane A, forms an obtuse angle (alpha) with a bridging portion 14 which connects the guide region and blade portion 43.

The inside surface F of the blade portion 43 is formed with a rib portion 11' flanked by two grooves 8, 9 arranged one above the other, such that the groove 9 lies at a smaller distance to the narrow edge 10 of the key shaft 41. Corresponding to the rib 11' is a groove 11 provided on the outer surface F' of the blade portion 43. Ribs 8', 9' on said surface correspond with the grooves 8, 9. The material of the key blade portion is thus substantially uniform (measured normally to the plane A) throughout its length. Viewing FIG. 1, the grooves 8, 9, 11 are effectively tangential to or intersect the plane A. Furthermore, each groove is formed having an arcuate angle, preferably greater than 45°.

From FIG. 1 it can further be seen that the blade portion 43 lies at an obtuse angle to the bridging portion 14.

The lateral offset of the plane A to the guide region 42 is such that the extension of the plane C of the side surface 12 of the guide region passes through the peak region S of the rib 11'. The extension D of the opposite side surface 12 of the guide region 42, which surface faces away from the plane A, lies at a distance f from the peak region S of the rib 11'. This distance f is greater than the distance e by which the peak region extends beyond the plane C.

V-cuts are provided in the blade portion 43, along the narrow edge 10 thereof.

Figure 2:
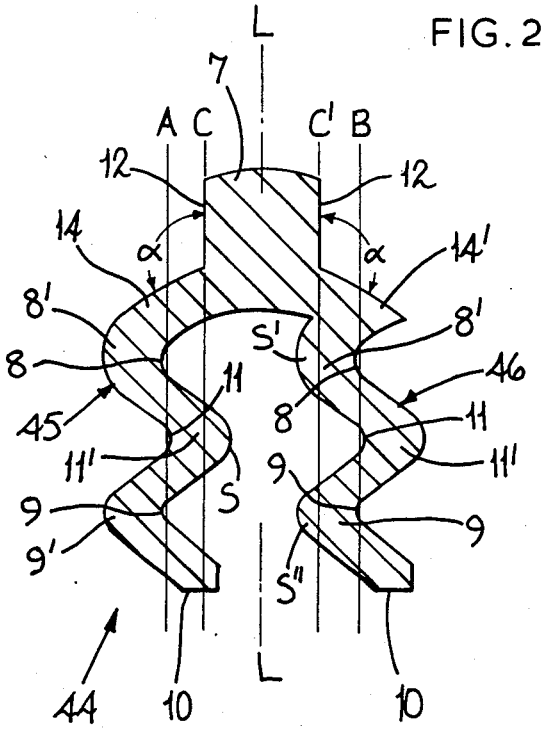
FIG. 2 is a cross-section, also on very enlarged scale, through a second key in accordance with the invention.

In FIG. 2 is shown the second key 44 in accordance with the invention. This key 44 has two blade portions 45, 46 which lie parallel to one another and are formed integral with each other through a connection with a common guide region 7 via bridging portions 14, 14'. In this case also the longitudinal central planes A, B of the two blade portions 45, 46 are laterally offset in relation to the guide region 7. In addition, the side surfaces 12 of the guide region 7, which surfaces face the planes A, B, form an obtuse angle (alpha) with the bridging portions 14, 14'. Also the extension of the plane C of the one side surface 12 passes through the peak region S of the rib 11' of the blade portion 45. Ribs and grooves of this blade portion correspond to that in FIG. 1 and bear the same reference numerals.

The extension of the plane C' of the opposite side surface 12 on the other hand passes through the peak regions S', S'' of the ribs 8' and 9' of the other blade portion 46, since the ribs and grooves of the two blade portions 45, 46 run parallel to one another, and the two planes A, B are spaced at the same distance from the longitudinal central plane L-L of the guide region 7.

The third key 2 in accordance with the invention (FIGS. 10 and 11) comprises a key shaft 3 and a handle 4, the shaft 3 again being bifurcated in cross-section. Thus, the two blade portions 5, 6 forming the fork legs extend from the central guide region 7 and are arranged symmetrically to the longitudinal central plane L-L. Furthermore, the longitudinal central planes A, B of the blade portions run parallel to one another so that the guide region 7 lies in the region between these planes A, B, that is to say offset to the planes A, B. On the inside surface F of each of the blade portions 5, 6 are two longitudinal grooves 8, 9 which are opposed to one another at the same distance from the narrow edge 10 of the blade portions 5, 6, and between which extends a rib portion 11'. Corresponding with the grooves and rib portion are formed, on the outside surface F' of each of the blade portions 5, 6, two ribs 8', 9' and a groove 11. Consequently, it will be appreciated, the grooves 8, 9 are arranged displaced in relation to the groove 11.

Each side surface 12 of the guide region 7 forms an obtuse angle (alpha) with the outer surface 13 of the bridging portion 14 and each blade portion 5, 6, in the narrow edge of which the V-cuts are formed, then itself forms an obtuse angle with the bridging portion 14.

In addition, the extension of the planes C,C' of each of the side surfaces of the guide region passes through the peak region S of each of the rib portions 11', which lie opposite one another.

In FIG. 11 the key 2 is shown as formed in a single piece. Alternatively the guide region 7, may be composed of two guide region portions 7', 7'' lying in a closed formation with one another in such a manner that each guide region portion 7', 7'' supports one of the blade portions 5, 6 (see FIG. 12). The closed formation is achieved by the one guide region portion 7'' having a groove 18 which is open towards the line of contact 17, into which groove 18 a rib 19 of the other guide region portion 7' is inserted to form a closed shape. For the purpose of obtaining a one-piece key the two ribs portions can be joined together in the region of the closed formation, e.g. by soldering, bonding, welding etc. If it is desired to obtain partner keys, each guide region portion 7', 7'' extends into the handle 4. As can be seen especially from FIG. 4, the thickness of the guide region 7 corresponds to the thickness of the handle 4.

Figure 6:
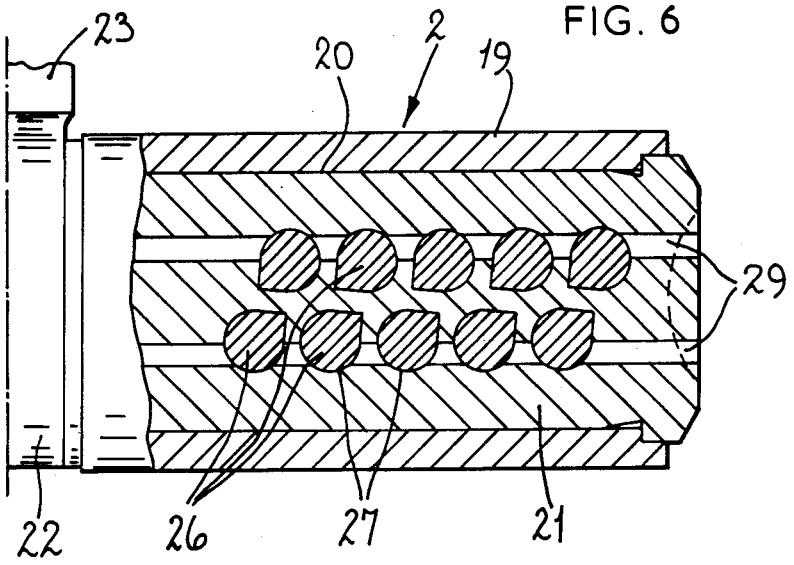
FIG. 6 is a section along the line VI—VI of FIG. 5.
Figure 7:
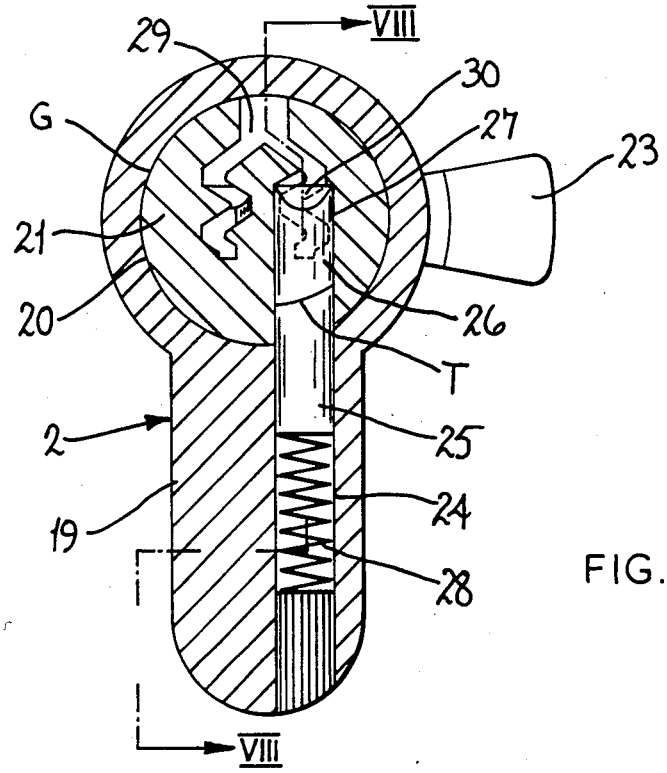
FIG. 7 is a cross-section through the lock cylinder of FIG. 6, taken in the region of the pin tumbler facing the insertion end.

The lock cylinder 1 receiving the third key in accordance with the invention has a cylinder housing 19 which is profiled in cross-section. A cylinder plug 21 is mounted for rotation in a bore 20 of the housing. The plug 21 is in a coupled relationship with a thrower hub 22 which supports a thrower 23 projecting radially. In the cylinder housing 19 are provided two rows of bores 24 of non-round cross-section, said rows extending parallel to one another, in which bores 24, tumbler pins 25 are guided, which are located in the housing and correspond with core pins 26. For the latter the cylinder plug 21 has corresponding bores 27. These pins 25, 26 have a somewhat tear drop shaped cross-section for rendering the tumbler pins non-rotational. It can be seen especially from FIG. 6 that the tumbler pins of the one row are arranged in gaps in relation to the tumbler pins of the other row. Accordingly the V-cuts 15 of the one key blade portions are offset to the V-cuts of the other key blade portion. The housing pins 25 are loaded by pin springs 28 so that when no key is inserted in the keyway 29 of the cylinder plug 21, the housing pins 25 cross the shear line G of the cylinder plug 21 and prevent a rotation of the cylinder plug. The keyway 29 has a contour which matches the cross-sectional profile of the key 2. Furthermore, the outer surface 7''' of the guide region 7 of the key has a round shape corresponding to the way the shear line runs.

In order that, regardless of the depth of the V-cuts, a secure control of the plug pins 25 is achieved, these latter have a roof-like ridge 30 such that the sloping surfaces lie in the insertion or withdrawal direction of the key. The key shaft 3 on the other hand has at its key tip the run-up inclined portion 32 which extends over both blade portions 5, 6. The two bridging portions 14 and the guide region 7 run together at the key tip 33. In combination with a funnel-shaped indentation 34 at the front of the plug, a so-called key guide, insertion of the key is facilitated reliably, while at the same time it is centralised in the keyway.

When the lock cylinder 1 is to be operated, the appropriate key 2 is inserted into the keyway 29. By the V-cuts provided on the narrow edges 10 the tumbler pins are so operated that their joint line T lies at the level of the shear line G of the cylinder plug. The cylinder plug 21 can then rotate without interruption and move therewith the thrower hub 22.

From the cross-sectional illustrations of the key it is clear the height of each blade portion enables V-cuts of a greater depth than usual to be formed therein and in addition a large number of possible cuts can be made with optimum spacing therebetween. In this way a large number of variations can be achieved without risk. Furthermore, the grooves provided on the two blade portions allow optimum profile variation. Similarly, as is indicated in chain-dot in FIG. 11, the guide region 7 may also be provided with profiled longitudinal grooves 31.

Alternatively, as illustrated, the profiles of the blade portion may be formed differently so that the grooves formed therein do not lie at the same level. In addition, the number of profiled longitudinal grooves of the one blade portion may be different from those of the other.

We claim:

1. Key for a cylinder lock comprising a guide region extending along a back edge portion of the key for guiding the key along a keyway of the cylinder, and at least one blade portion having a narrow edge opposite the guide region, in which edge V-cuts are formed for operating tumbler pins of the cylinder, said blade portion also having formed in one side surface thereof at least one longitudinal rib portion flanked at each side by a longitudinal groove, wherein each blade portion is connected to the guide region by a bridging portion and the longitudinal central plane of each blade portion is offset from that of the guide region such that the side surface of the guide region facing said plane forms an obtuse angle with the bridging portion, and further wherein an extension of the plane of the side surface of the guide region passes through the peak region of the rib portion formed in the side surface of the blade portion.

2. Key according to claim 1 wherein the extension of the plane of the opposite side surface of the guide region is spaced from said peak region of each rib portion by a distance which is greater than the distance by which such peak region extends beyond the extension of the plane of said one side surface of the guide region.

3. Key according to claim 2 further comprising two blade portions extending parallel with one another and each connected to the guide region by a bridging portion.

4. Key according to claim 2 further comprising two blade portions extending parallel with one another, each portion having an associated guide region portion with which it is connected by a bridging portion and the two guide portions being interconnected to form a single guide region having a closed form which can be received in the keyway of the cylinder.

5. Key according to claim 4 wherein each guide region portion extends into the handle of the key.

6. Key according to claim 3 wherein the two blade portions are of the same shape.

7. Key according to claim 3 wherein the two blade portions are symmetrical in shape, the plane of symmetry coinciding with the longitudinal central plane of the guide region.

8. Key according to claim 1 wherein the grooves flanking each rib portion through the peak region of which the extension of the plane of the guide region side surface passes extend beyond the longitudinal central plane of the blade portion.

9. Key according to claim 8 wherein the extension of the plane of the opposite side surface of the guide region is spaced from said peak region of each rib portion by a distance which is greater than the distance by which such peak region extends beyond the extension of the plane of said one side surface of the guide region.

10. Key according to claim 9 further comprising two blade portions extending parallel with one another and each connected to the guide region by a bridging portion.

11. Key according to claim 9 further comprising two blade portions extending parallel with one another, each portion having an associated guide region portion with which it is connected by a bridging portion and the two guide region portions being interconnected to form a single guide region having a closed form which can be received in the keyway of the cylinder.

12. Key according to claim 11 wherein each guide region portion extends into the handle of the key.

13. Key accord to claim 10 wherein the two blade portions are of the same shape.

14. Key according to claim 10 wherein the two blade portions are symmetrical in shape, the plane of the symmetry coinciding with the longitudinal central plane of the guide region.

15. Key according claim 1 further comprising two blade portions extending parallel with one another and each connected to the guide region by a bridging portion.

16. Key according to claim 1 further comprising two blade portions extending parallel with one another, each portion having an associated guide region portion with which it is connected by a bridging portion and the two guide region portions being interconnected to form a single guide region having a closed form which can be received in the keyway of the cylinder.

17. Key according to claim 16 wherein each guide region portion extends into the handle of the key.

18. Key according to claim 15 wherein the two blade portions are of the same shape.

19. Key according to claim 15 wherein the two blade portions are symmetrical in shape, the plane of symmetry coinciding with the longitudinal central plane of the guide region.

20. Key according to claim 16 wherein the two blade portions are of the same shape.

21. Key according to claim 16 wherein the two blade portions are symmetrical in shape, the plane of symmetry coinciding with the longitudinal central plane of the guide region.

22. Key according to claim 1 wherein the guide region and each blade portion run together at the tip of the key.

* * * * *